US006705090B2

(12) United States Patent
Billman et al.

(10) Patent No.: US 6,705,090 B2
(45) Date of Patent: Mar. 16, 2004

(54) ICE MAKER HARVEST CONTROL AND METHOD

(75) Inventors: Gregory M. Billman, Mason City, IA (US); Donald E. Wiley, Jr., Mason City, IA (US); Kyle B. Elsom, Mason City, IA (US)

(73) Assignee: IMI Cornelius Inc., Anoka, MN (US)

( * ) Notice: Subject to any disclaimer, the term of this patent is extended or adjusted under 35 U.S.C. 154(b) by 227 days.

(21) Appl. No.: 10/123,623

(22) Filed: Apr. 15, 2002

(65) Prior Publication Data

US 2002/0157406 A1 Oct. 31, 2002

Related U.S. Application Data

(63) Continuation of application No. 09/930,420, filed on Aug. 15, 2001, now Pat. No. 6,405,546.
(60) Provisional application No. 60/225,663, filed on Aug. 16, 2000.

(51) Int. Cl.[7] ..... F25C 1/00
(52) U.S. Cl. ..... 62/74
(58) Field of Search ..... 62/74, 79, 135, 62/374

(56) References Cited

U.S. PATENT DOCUMENTS 4,009,595 A * 3/1977 Barnard et al. ..... 62/300
4,990,169 A * 2/1991 Broadbent ..... 426/250
5,042,263 A * 8/1991 Day et al. ..... 62/138
5,219,383 A * 6/1993 Minari et al. ..... 62/347
5,289,691 A * 3/1994 Schlosser et al. ..... 62/303

* cited by examiner

*Primary Examiner*—William E. Tapolcai
*Assistant Examiner*—Mohammad M. Ali
(74) *Attorney, Agent, or Firm*—Sten Erik Hakanson

(57) ABSTRACT

The present invention comprises an ice harvest system for use in an ice maker. The ice maker herein includes a refrigeration system for cooling of an evaporator. Ice is formed thereon as water is pumped by a re-circulating pump to flow from a water distribution tube over the evaporator surface. Water that is not immediately frozen thereon flows into a water pan positioned there below. A pressure fitting is positioned in the pan at the bottom thereof and connected to a pneumatic tube. The pneumatic tube is connected to a pressure sensor located on a control board at a position remote from the water pan. Pressure is communicated through the tube to the pressure sensor as a function of the depth of the water in the pan. This pressure is converted by a microprocessor of the control board for interpretation as a water level in the pan. As the water level in the tray lowers due to the formation of ice, the pressure transmitted to the pressure sensor reduces from a predetermined high or full water level. A harvest point occurs which corresponds to the sensing of a predetermined low water level/low pressure point indicating sufficient ice has formed on the evaporator.

7 Claims, 6 Drawing Sheets

51
START
52
COMPRESSOR ON
54
DUMP & FILL VALVES OPEN
56
PUMP ON LEVEL ?
NO
YES
58
TURN ON PUMP
60
MIN. WATER LEVEL ?
NO
YES
62
TURN PUMP OFF
64
PUMP ON LEVEL ?
NO
YES
66
PUMP ON FILL VALVE OFF
68
MIN. WATER LEVEL ?
NO
YES
70
PUMP OFF, CLOSE DUMP VALVE, OPEN FILL VALVE
72
MAX. WATER LEVEL ?
NO
YES
74
FILL VALVE OFF
76
45 SEC. ELAPSED ?
NO
YES
78
PUMP ON
80
45 SEC. ELAPSED ?
NO
YES
A

ICE MAKER HARVEST CONTROL AND METHOD

The present application is a continuation of application Ser. No. 09/930,420, filed Aug. 15, 2001 now U.S. Pat. No. 6,405,546 and claims benefits of Prov. No. 60/225,663 file Aug. 16, 2000.

FIELD OF THE INVENTION

The present application relates generally to ice making machines, and specifically to ice harvest controls and sensors as used therein.

BACKGROUND

Ice making machines are well known in the art, and typically include an ice cube making mechanism located within a housing along with an insulated ice retaining bin for holding a volume of ice cubes produced by the ice forming mechanism. In one type of ice maker a vertically oriented evaporator plate is used to form a slab of ice characterized by a plurality of individual cubes connected by ice bridges there between. As the slab falls from the evaporator plate into the ice bin, the ice bridges have a tendency to break forming smaller slab pieces and individual cubes. As is well understood, the ice slab is formed by the circulating of water over the cooled surface of the evaporator plate, the plate forming a part of a refrigeration system including a compressor and a condenser.

Of critical importance to ice makers of this general type, is knowing when the ice is of sufficient thickness to be harvested. Once the harvest point is reached, the making of ice is discontinued by stopping the flow of water over the evaporator and the cooling thereof. The evaporator plate is then heated, typically by the use of hot gas from the refrigeration system. The ice slab then melts slightly releasing its adhesion to the plate so that it can fall into the bin positioned there below. Various controls have been proposed and used over the years to signal the harvest point. One approach is to use electrical conductivity whereby an electrical probe is positioned closely adjacent the surface of the evaporator. When ice builds to a desired thickness the plate comes in contact with the flow of water causing a conductivity connection which can trigger the harvest cycle. A problem with this sensor type concerns the evaporative or electrically caused chemical deposition on the probe resulting in a weak or no signal failure condition wherein the harvest point is not detected.

The harvest point can also be indicated by the lost water approach. In ice makers of the above described type, a water pan is positioned below the evaporator to catch the water not immediately frozen thereon. The water is then recycled from the tray back over the evaporator. If water that freezes on the evaporator is not replenished into that water circulatory system, then the water level in the pan will gradually be lowered as the ice is formed. Thus, various techniques have been used to sense the low water level point that corresponds with a desired ice build-up or thickness. It is known to use an electromechanical float mechanism that can signal when that point is reached. However, such systems are prone to mechanical failure whereby contact with the water can lead to corrosion and fouling problems. Other sensors including photo optical sensors are used, but again are located in or closely adjacent the water pan and thereby subject to corrosive or depositional effects that can degrade the performance thereof.

Accordingly, it would be desirable to have an ice harvest sensing system that is significantly less likely to be damaged or subject to corrosive or depositional effects and can thereby accurately and reproducibly sense, over time, the proper harvest point.

SUMMARY OF THE INVENTION:

The present invention comprises an ice harvest system for use in an ice maker. The ice maker herein works in the conventional manner wherein a refrigeration system provides for cooling of the evaporator. Ice is formed thereon as water is pumped by a re-circulating pump to flow from a water distribution tube over the evaporator surface. Water that is not frozen thereon flows into a water pan positioned there below. A pressure fitting is positioned in the pan at the bottom thereof and connected to a pneumatic tube. The pneumatic tube is connected to a pressure sensor located on a control board at a position remote from the water pan. As water fills the pan it attempts to flow into the fitting interior. Air trapped in the fitting and in the tube is compressed slightly by this action and this pressure is communicated through the tube to the pressure transducer/sensor. The sensor then converts this pressure into a voltage reading, which is input to and converted by a microprocessor of the control board for interpretation as a pressure value. As the water level in the tray lowers, the pressure transmitted to the pressure sensor reduces. When a predetermined low pressure is sensed, a harvest point is reached and a harvest cycle is initiated. In particular, the water pump is stopped along with cooling of the evaporator. A hot gas valve is then opened to warm the evaporator resulting in the discharge of the ice there from.

A major advantage of the pressure sensing strategy of the present invention is the location of the pressure sensor on the control board at a point within the ice maker substantially distant from the water tray. As a result thereof, any water based degradation thereof due to sedimentation, corrosion or the like is greatly minimized, if not eliminated. The control of the present invention is also low in cost as the tube and pressure fitting are inexpensive and easily replaced and as the pressure sensor is relatively inexpensive relative to other sensor/transducer technologies.

DESCRIPTION OF THE DRAWINGS

A better understanding of the structure, function, operation and advantages of the present invention can be had by referring to the following detailed description which refers to the following drawing figures, wherein.

DETAILED DESCRIPTION OF THE PREFERRED EMBODIMENT

Figure 1:
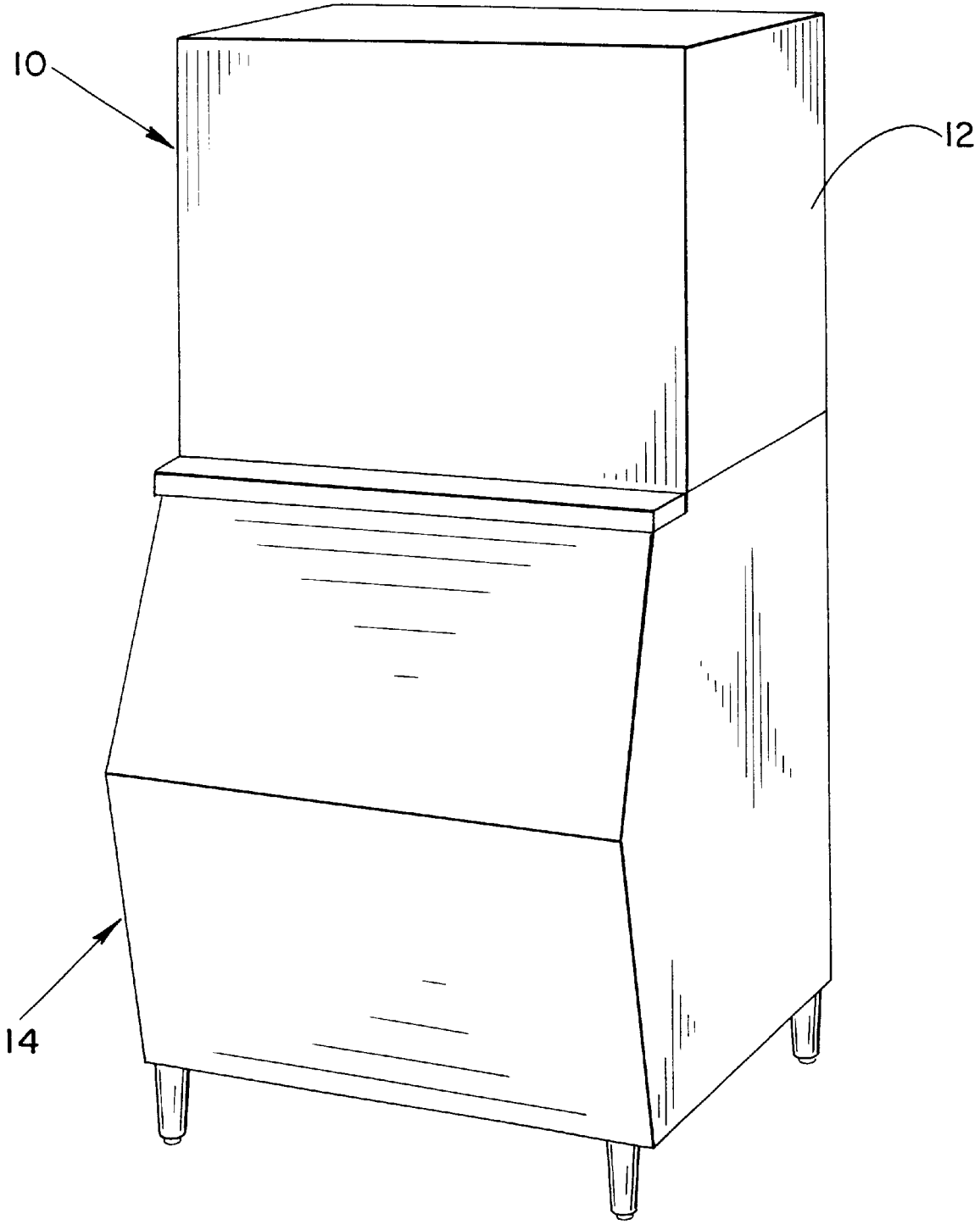
FIG. 1 shows a perspective view of an ice maker mounted atop an ice storage bin.

The ice maker of the present invention is seen in FIG. 1, and referred to generally by the numeral 10. Ice maker 10 includes an exterior housing 12 and is positioned atop an insulated ice retaining bin 14. As is further understood by referring to FIGS. 2 and 3, and as is conventional in the art, ice maker 10 includes a vertical ice forming evaporator plate 16, a condenser and fan 18 and a compressor 20 connected by high pressure refrigerant lines 21*a* and low pressure line 21*b*. As is also well understood, the refrigeration system herein includes an expansion valve 22 and a hot gas valve 24. A water catching pan 26 is positioned below evaporator 16 and includes a partial cover 27. A water distribution tube 28 having a water inlet 29 extends along and above evaporator 16. A water supply solenoid valve 30 has an inlet connected to a source of potable water, not shown, and an outlet line 31 supplying water to pan 26. A water pump 32 provides for circulating water from outlet 32*b* thereof to inlet 29 of distribution tube 28 along a water line 34. A solenoid operated dump valve 36 is fluidly connected to line 34 and serves, when open, to direct water pumped thereto to a drain, not shown. An evaporator curtain 37 is pivotally positioned closely adjacent evaporator 16 and includes a magnetic switch 38 for indication when it has moved away from evaporator 16 to an open position indicated by the dashed line representation thereof. For purposes of clarity of the view of FIG. 2, the various fluid connections of pump 32, dump valve 36 and water supply valve 30 are not shown, such being represented in schematic form in FIG. 3.

Figure 2:
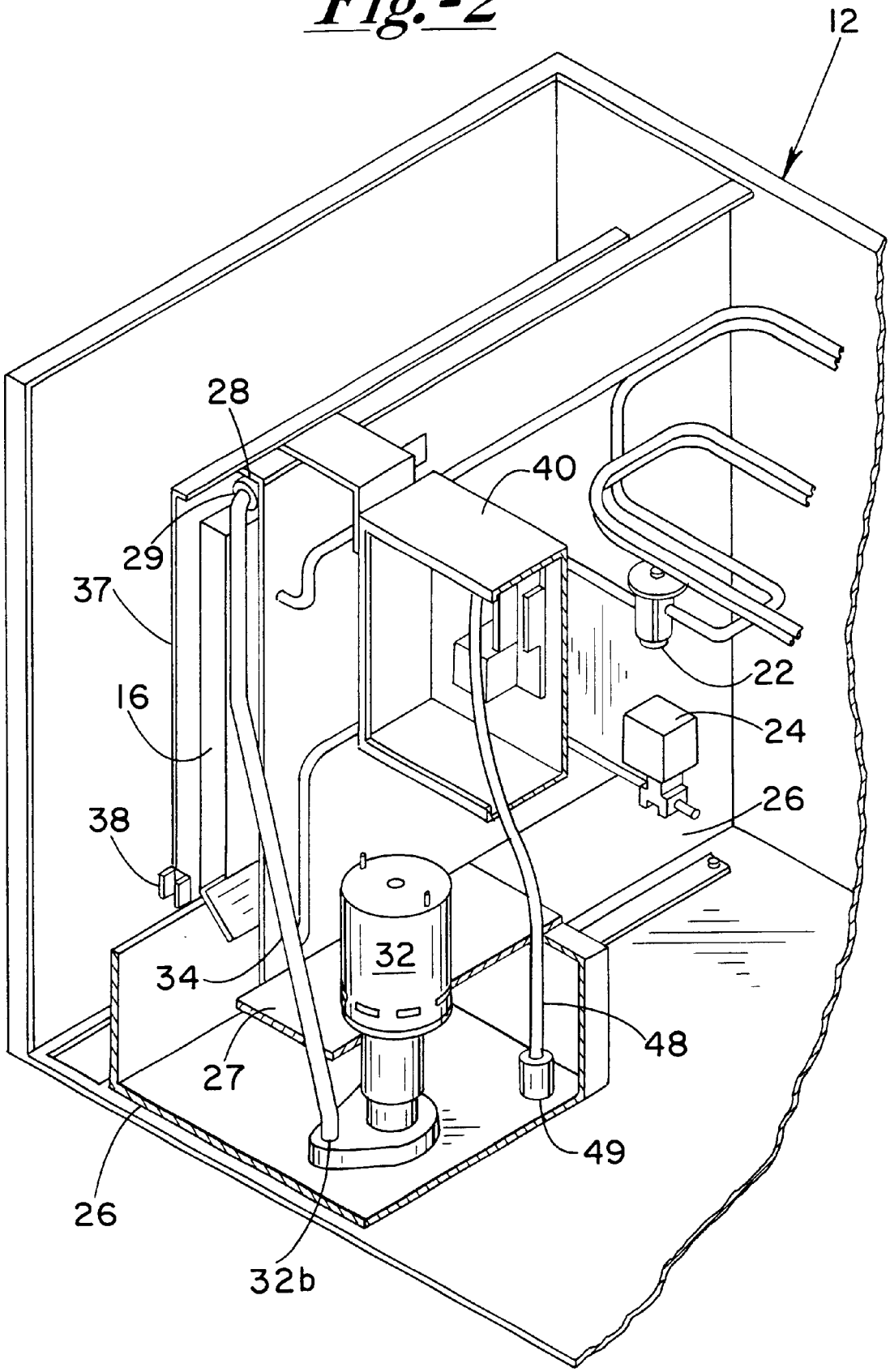
FIG. 2 shows a partial cross-sectional view of the interior of the ice maker.
Figure 3:
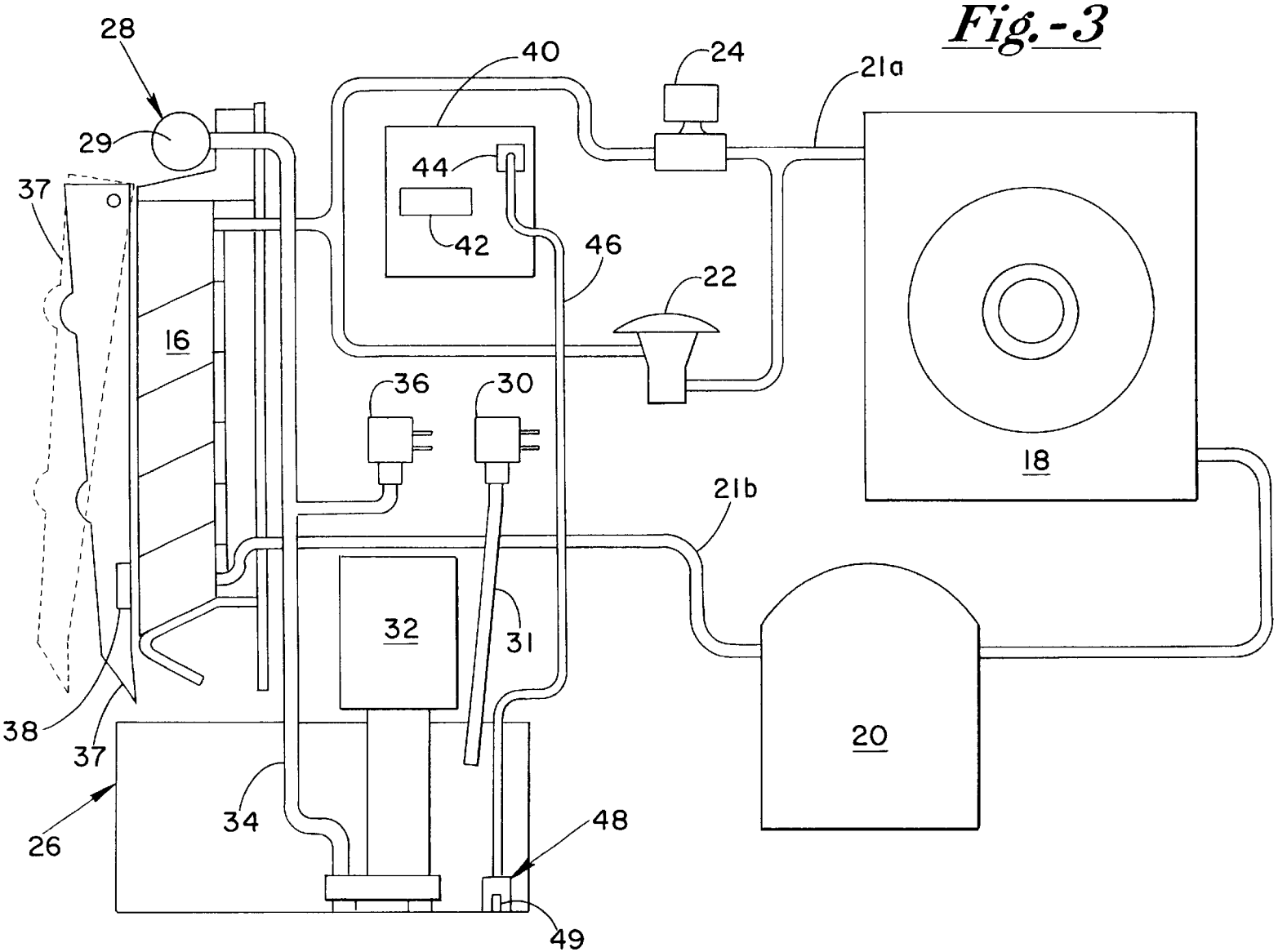
FIG. 3 shows a schematic representation of the ice maker.
Figure 4:
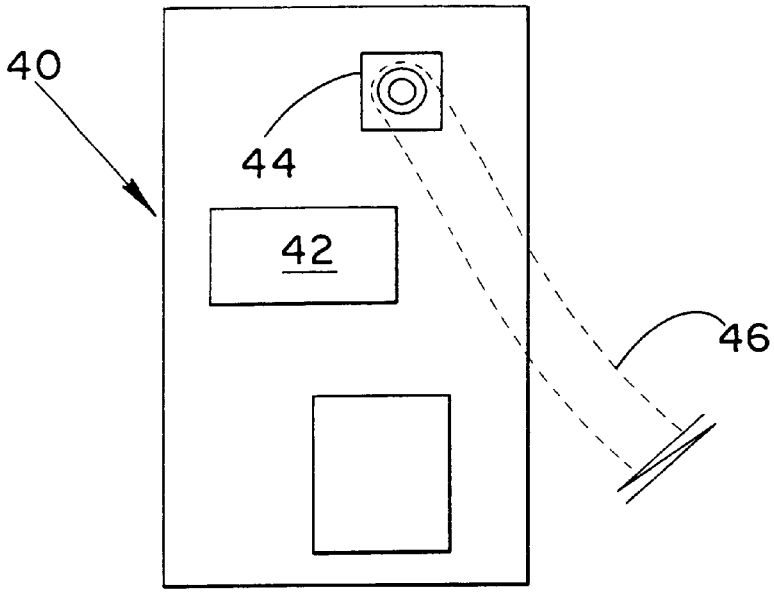
FIG. 4 shows an enlarged view of the ice maker control board.

As particularly seen in FIG. 4, and also by referring to FIG. 2, an electronic control board 40 is located within a separate housing 41 at a position remote and physically isolated from pan 26 and evaporator 16. Control board 40 includes a microprocessor 42 for controlling the operation of ice maker 10. Board 40 includes a pressure sensor 44, such as manufactured and sold by Motorola, Inc. of Phoenix, Ariz., and identified as model MPXV5004G. As understood by also viewing FIG. 5, a plastic pneumatic tube 46, shown in dashed outline, is connected to sensor 44 and on its opposite end to a cylindrical air cup or fitting 48. Those of skill will understand that housing 41 includes a cover, not shown, that provides for the enclosing and protection of control 40 and sensor 44 therein and through which tube 46 passes prior to connecting to sensor 44.

A Fitting 48 resides in pan 26 at the bottom thereof and is press fit within a circular ridge 49 that is formed as an integral molded portion of the bottom surface of pan 26. Fitting 48 includes an outer housing 48*a* defining an inner air trapping area 48*b* and a tube connecting portion 48*c*. Four water flow openings 50 exist around a bottom perimeter of housing 48*a*.

Figure 5:
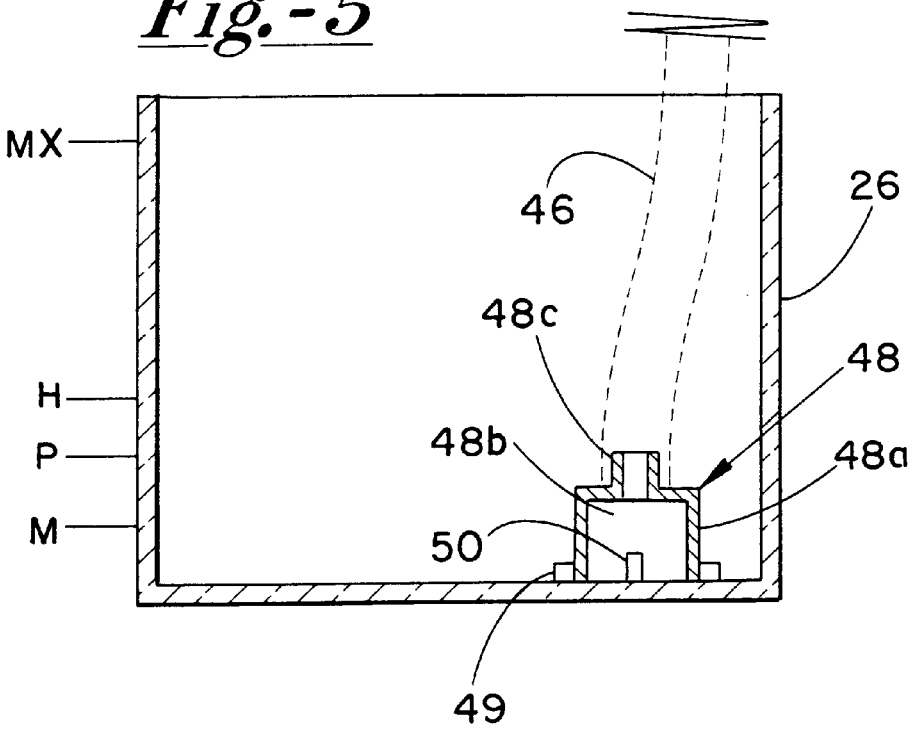
FIG. 5 shows an enlarged partial cross-sectional view of the water pan and pressure fitting.
Figure 6A:
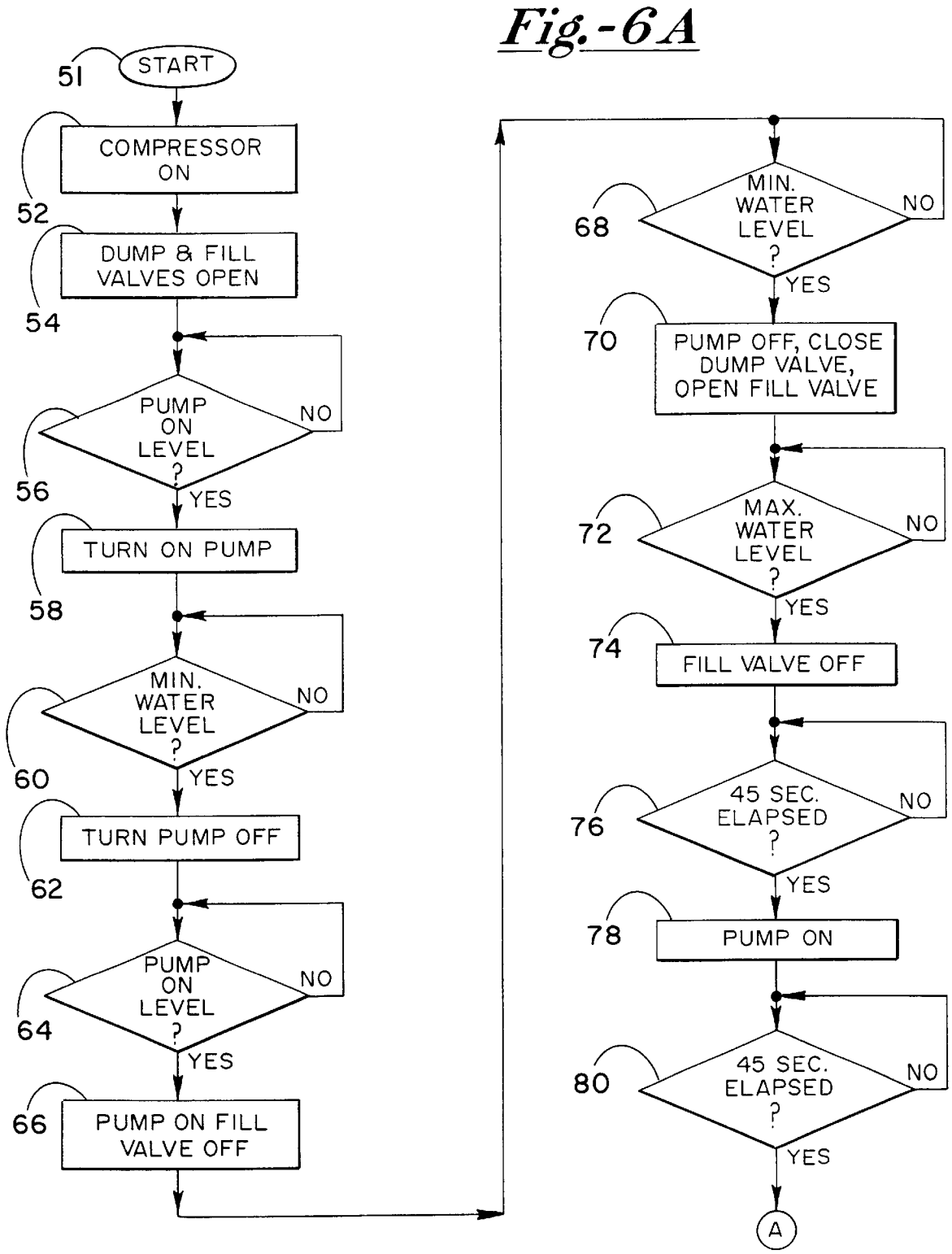
FIGS. 6A and 6B show a flow diagram of the general control strategy of the present invention.
Figure 6B:
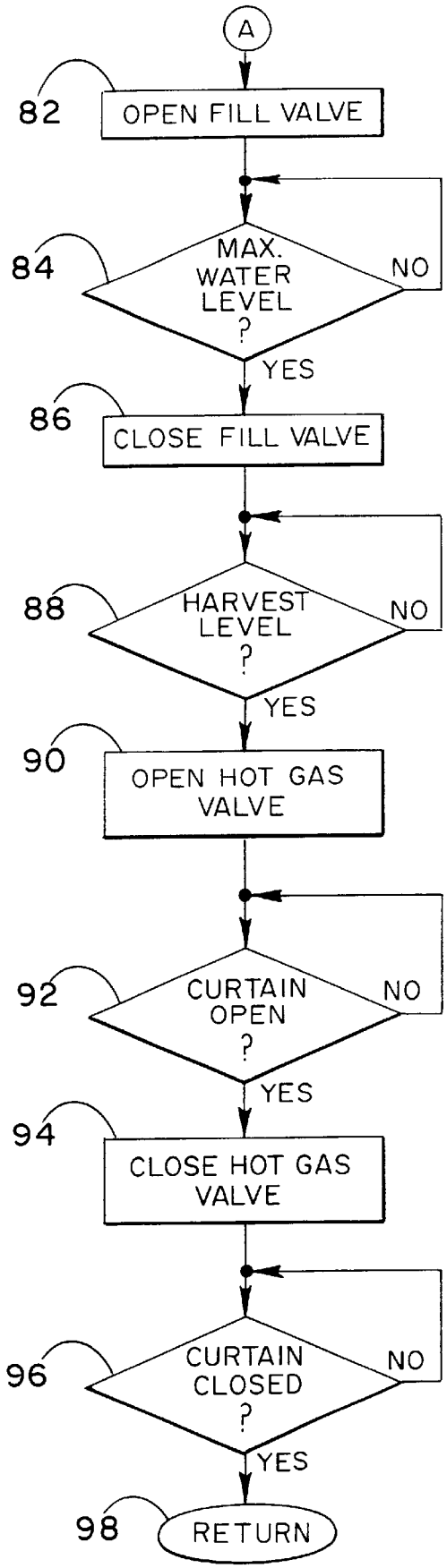

The operation of the present invention can be better understood by referring to the flow diagram of FIGS. 6A and 6B wherein the basic operation of the present invention is shown. At start block 51 power is provided to control 40. At block 52 compressor 20 is turned on and substantially simultaneously at block 54 fill valve 30 and dump valve 36 are opened. Thus, cooling of evaporator 18 begins and water flows into pan 26. At decision block 56, once a predetermined pump-on water level is reached in pan 26, as indicated by the level line represented by the letter P in FIG. 5, circulatory water pump 32 is turned on at block 58. The pump-on point is sensed by sensor 44. In particular, as water fills pan 26, water flows through holes 50 of fitting 48. As that occurs, air trapped in area 48*b* is slightly compressed and forced into tube 46 which communicates such pressure increase to sensor 44. That pressure is then input as a voltage to microprocessor 42 which assigns a numerical value thereto corresponding to a pressure scale. Therefore, when the predetermined pressure value is sensed that corresponds to the pressure at level P, pump 32 is turned on. Because of the fluid connections of pump 32 and dump valve 36, the action of pump 32 serves to move any water in pan 26 to valve 36 causing the draining away thereof. Thus, a minimum water level, indicated by the level line represented by the letter M in FIG. 5, is sensed in the same manner as described above for level P. When that predetermined volume of the water has been removed from pan 26, pump 32 is stopped at block 62. As the water supply valve remains on, the level in pan 26 begins to rise and when the P level is again sensed at block 64, then at block 66, pump 32 is re-started and fill valve 30 closed. As dump valve 34 remains open, water will again be pumped from pan 26. At block 68 control 40 again senses for the attainment of the M level. When that occurs, then, at block 70, water pump 32 is stopped, dump valve 34 is closed and fill valve 30 is opened. It can be appreciated that blocks 52–68 serve as a dump cycle whereby any contaminants that have accumulated in pan 26 are agitated by the action of pump 32 and the inflow of water and are twice flushed in this manner and removed from the system.

At block 72 control 40 monitors for the attainment of a maximum fill level for pan 26 indicated by the level line denoted by letters MX. When this highest pressure level is sensed, then at block 74 fill valve 30 is closed. At block 76, a 45 second clock is initiated to provide for some precooling of the water delivered to pan 26 through flow over evaporator 16. At block 78 pump 32 is again turned on. A further 45 second clock is set at block 80, and when that has timed out, fill valve 30 is opened. It will be understood by those of skill that action of pump 32 will serve to fill fluid line 34 and distribution tube 28 which will slightly lower the level of water in pan 26 below that of the desired maximum water volume indicated by level MX. Thus, fill valve 30 is opened at block 82, to replenish that volume as is determined at block 84. At block 86, fill valve 30 is closed when the desired starting maximum level MX is again attained.

At this point pump 32 is operating to flow water over evaporator 16 as such is being cooled by the action of compressor 20, condenser and fan 18 and expansion valve 22, all as operated by control 40. As ice forms on evaporator 16, the water level in pan 26 goes down as does the pressure sensed by sensor 44. When a predetermined harvest water level is reached, as indicated by the level line denoted H, a corresponding predetermined pressure value is sensed by control 40 at block 88. When the harvest point is indicated, pump 32 is stopped and hot gas valve 24 is opened at block 90, causing evaporator 16 to warm resulting in the release of the ice slab formed thereon. Of course, those of skill will understand that other heating means known in the art could be employed, such as, an electrical heater integral with the ice forming evaporator. As is well understood, when the slab of ice falls from evaporator 16, curtain 37 is opened and switch 38 is closed, signalling to the control 40 the release of the ice slab from evaporator 16. As is also known, to insure that the slab of ice has fallen into bin 12 and is no longer in the vicinity of evaporator 16, at block 96, the control herein awaits the remaking of switch 38 which occurs when curtain 36 is free to swing back to its normal closed position unobstructed by any ice. At block 98 the control returns to start and initiates a further ice making cycle.

It was found that the pressure-based water level sensing as described herein provides for very accurate and repeatable determination and control thereof, and hence, for very reliable control of the harvest cycle of an ice maker. In particular, the physical isolation of the pressure sensor 44 from pan 26 contributes to this improved performance by serving to prevent any degradation of the sensor due to the presence of water and/or the corrosive impact thereof.

What is claimed is:

1. A method of controlling an ice maker, the ice maker having a refrigeration system for providing cooling of an ice forming evaporator, and a water circulatory system for circulating water over the evaporator for forming ice thereon as the evaporator is cooled by the refrigeration system, and the evaporator having a water receiving pan positioned there below for receiving water flowing off the evaporator, a water fitting secured within the water receiving pan having an exterior surface defining an interior area and one or more openings through the exterior surface for providing fluid communication into the fitting interior area by water retained in the water receiving pan, a tube fluidly connected on one end thereof to the water fitting, and on the other end thereof to a pressure sensor so that as water flows into the fitting interior area a pressure is communicated to the pressure sensor that corresponds to the level of water in the water receiving pan, and the pressure sensor forming a part of a control board, the control board located at a position remote from the water receiving pan and functioning to control the operation of the refrigeration and water circulatory system with respect to the sensed level of water in the water receiving pan, the method comprising the steps of: cooling the evaporator for a first period of time before circulating water over the evaporator, commencing an ice making cycle by operating the water circulatory system to circulate water over the evaporator after the lapse of the first period of time in order to build ice thereon, initiating a defrost cycle when a harvest level of water in the water receiving pan is sensed by the control board.

2. The method as defined in claim 1 and the control board operating a water supply valve for adding water to the water circulatory system and further including the step of adding water to the circulatory system to a sensed maximum water level in the water receiving pan prior to initiating the ice making cycle.

3. The method as defined in claim 2, and immediately after the initiation of the ice making cycle adding water to the maximum water level if the control board senses the water level in the water receiving pan is at a level below the maximum level.

4. The method as defined in claim 1, and further including the steps of the control board sensing a minimum water level and an intermediate water level between the minimum and harvest levels and starting the operation of the water circulatory system when the intermediate water level is sensed and subsequently draining water from the water receiving pan through a dump valve operated by the control board for flushing the water receiving pan.

5. The method as defined in claim 4, and further including the steps of flushing the water receiving pan one or more times prior to initiating the ice making cycle.

6. The method as defined in claim 3, and further including the steps of the control board sensing a minimum water level and an intermediate water level between the minimum and harvest levels and starting the operation of the water circulatory system when the intermediate water level is sensed and subsequently draining water from the water receiving pan through a dump valve operated by the control board for flushing the water receiving pan.

7. The method as defined in claim 6, and further including the steps of flushing the water receiving pan one or more times prior to initiating the ice making cycle.

* * * * *